US005128642A

United States Patent [19]

Anders et al.

[11] Patent Number: 5,128,642

[45] Date of Patent: Jul. 7, 1992

[54] DEVICE FOR DEMAGNETIZING A PICTURE TUBE

[75] Inventors: Herbert Anders; Petrus C. J. J. Van Loon; Jimmy Tjon; Adrianus P. M. Vervoort, all of Tilburg, Netherlands

[73] Assignee: U.S. Philips Corporation, New York, N.Y.

[21] Appl. No.: 783,288

[22] Filed: Oct. 28, 1991

[30] Foreign Application Priority Data

Nov. 30, 1990 [NL] Netherlands ..... 9002618

[51] Int. Cl.[5] ..... H01F 7/20; H01F 13/00

[52] U.S. Cl. ..... 335/284; 361/150; 315/8; 336/192

[58] Field of Search ..... 335/284, 214; 336/192; 361/150; 315/8

[56] References Cited

U.S. PATENT DOCUMENTS 3,445,730 5/1969 Kahn ..... 335/284

4,812,946 3/1989 Prigent et al. ..... 361/150

*Primary Examiner*—Leo P. Picard

*Assistant Examiner*—Ramon M. Barrera

*Attorney, Agent, or Firm*—Robert J. Kraus

[57] ABSTRACT

The device comprises a demagnetization coil (1) wound from electrically conducting insulated wire (5) and surrounded by an electrically insulating sheath (7). A connection member (17) is connected to the two ends of the wire (5). The connections (19) between the connection member (17) and the wire (5) are surrounded by an electrically insulating envelope constituted by a sheet (21) of electrically insulating foil, which is folded so that the connections (19) and the adjoining parts of the sheath (7) are disposed between the facing parts of the sheet (21). The edges of the sheet (21) conducting each other are connected to each other by means of a welding connection (23). The sheet is further connected by means of a welding connection (23) to the sheath (7) and to an envelope of the connection member (17). The sheet 21 constitutes an envelope for the connections (19), which is tight but for one lead-through opening for the connection member (17).

6 Claims, 2 Drawing Sheets

DEVICE FOR DEMAGNETIZING A PICTURE TUBE

Figure 1:
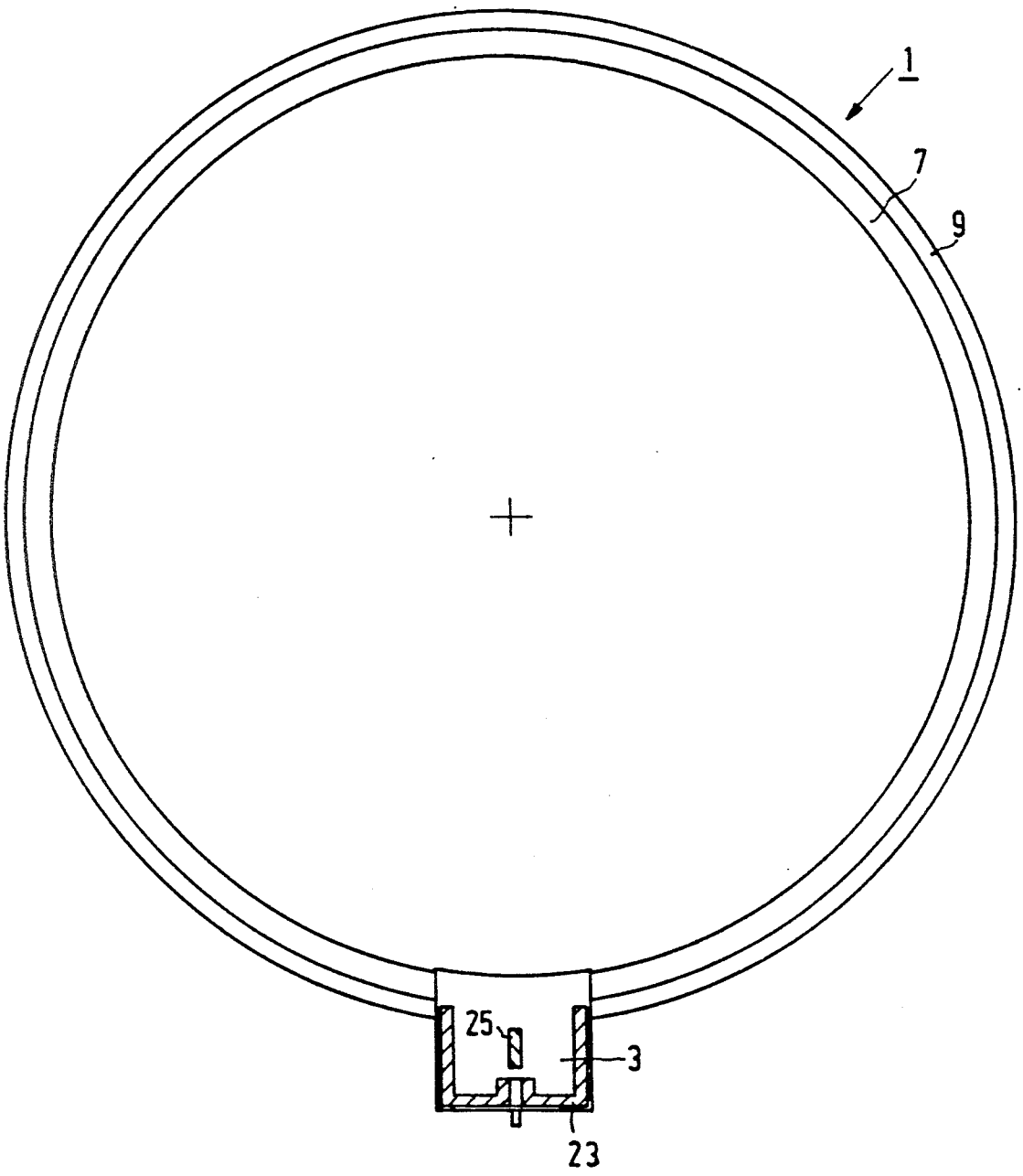

The invention relates to a device for demagnetizing a picture tube of a television receiver comprising at least one demagnetization coil wound from electrically conducting insulated wire and surrounded by a sheath formed from electrically insulating material, which coil is provided with a connection member connected to the two ends of the wire, the connections between the connection member and the wire being surrounded by an electrically insulating envelope cooperating with the sheath.

Such a device is known from U.S. Pat. No. 3,965,386. Examples of demagnetization coils for such devices are known from Philips Data Handbook DC 05 (1990), pp. 283 and 289. In the known coils, a large number of complicated operations is required for connecting the connection member (a cable or a connector) to the ends of the wire and for providing an insulating envelope around the connections formed. The cost price of the known device is adversely affected thereby.

It is an object of the invention to provide a device of the kind mentioned in the opening paragraph, in which the connection member with the associated insulation can be provided in a comparatively simple manner. For this purpose, the device according to the invention is characterized in that the envelope is constituted by a sheet of electrically insulating foil, which is folded together so that the connections between the connection member and the wire and the parts of the sheath located in the proximity of these connections are disposed between the facing parts of the sheet, the edges of the sheet touching each other being connected to each other by means of a welding connection and the sheet being further connected by means of a welding connection to the sheath and to an envelope of the connection member, in a manner such that the sheet or foil constitutes a substantially tight envelope for the connections.

The cost price of the insulating foil is negligible and the welding connections can be established rapidly and simply by means of automatized tools.

A preferred embodiment of the device according to the invention is characterized in that the connection member comprises a cable having two electrically conducting insulated cores, whose free ends are connected electrically and mechanically to corresponding ends of the wire, which cable is directed near the connections substantially transversely to the longitudinal direction of the wire. The free ends of the cores of the cable can be simply connected directly to the free ends of the wire, for example by means of a soldering or welding connection.

An embodiment, in which no soldering or welding connection is required, is characterized in that each connection between the cable and the wire comprises a deformable metal connection member, in which the end portions of the wire and of a core of the cable are secured with clamping fit by deformation of the connection member. In order to prevent that the connections between the wire and the cable contact each other, a further preferred embodiment of the device according to the invention is characterized in that the facing parts of the sheet are connected to each other in a region between the two connections by means of a further welding connection in order to form a separation wall between these connections.

In order to optimize the reliability of the welding connection between the sheath and the insulating foil, a further preferred embodiment of the device according to the invention is characterized in that the sheet of electrically insulating foil is made of the same material as the sheath of the coil.

These and other aspects of the invention will be described more fully with reference to the drawing.

Figure 2:
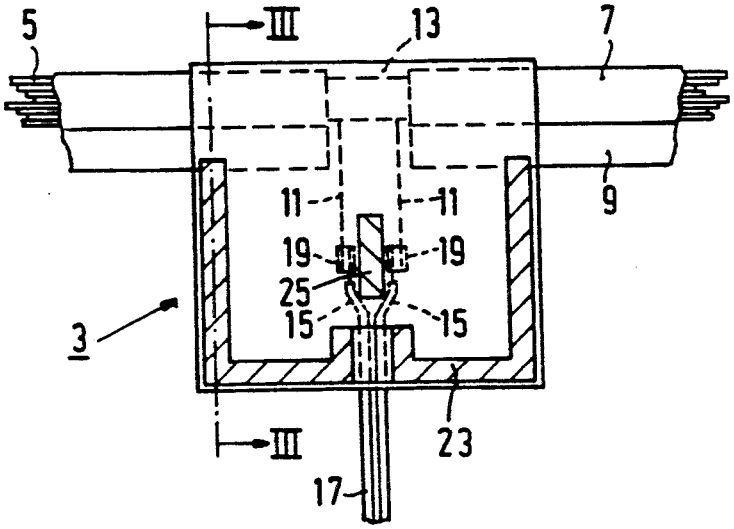
Figure 3:
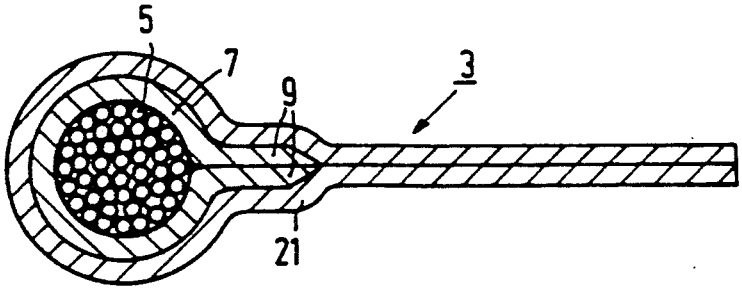
Figure 4A:
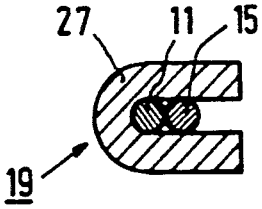
Figure 4B:
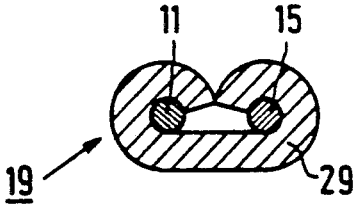

FIG. 1 shows an embodiment of a demagnetization coil suitable for a device according to the invention, FIG. 2 shows on an enlarged scale a detail of the coil shown in FIG. 1, FIG. 3 shows a cross-section of the detail shown in FIG. 2 taken on the line III—III, and FIGS. 4A and 4B show cross-sections of two embodiments of a connection between a wire of the coil and a core of a cable.

FIG. 1 shows an embodiment of a demagnetization coil for a device for demagnetizing a picture tube of a television receiver, as described, for example, in U.S. Pat. No. 3,965,386. FIGS. 2 and 3 show on an enlarged scale a connection part 3 of the coil 1.

The coil 1 is wound from an electrically conducting wire 5, which is surrounded by an insulation layer (not shown). The coil 1 is surrounded by an electrically insulating sheath 7, which is formed from a suitable foil of synthetic material, for example, PVC. This foil is folded around the turns formed from the wire 5, after which the edges 9 of the foil are welded to each other. The two free ends 11 of the wire 5 (indicated by dotted lines in FIG. 2) are passed to the exterior through an interruption in the insulating sheath 7. They are connected electrically and mechanically to the free ends freed from insulation of two cores 15 of a cable 17, which is directed near the connections approximately transversely to the longitudinal direction of the wire 5. The cable 17 may take, for example, the form of a flat tape cable or may consist of loose cores that may be twisted. The connections 19 between the cores 15 and the ends 11 of the wire 5 will be described more fully below with reference to FIGS. 4A and 4B.

The connections 19 are surrounded by an envelope, which is formed by a sheet of electrically insulating foil 21, preferably of the same material as the sheath 7. The sheet 21 may consist of one or more layers of foil and is folded so that the connections 19 and the parts of the sheath 7 located near these connections are disposed between the facing parts of the sheet. The edges of the foil 21, which contact each other, are connected to each other by means of a welding connection (for example by ultrasonic or high-frequency welding). Further parts of the edges of the foil 21 are also connected by a welding connection to the sheath 7. The said welding connections are designated in FIGS. 1 and 2 by reference numeral 23. The welding connections 23 are prolonged over a certain distance along the cable 17 so that they also connect the insulation sheath of the cable to the foil 21. The foil 21 thus constitutes an envelope of the connections 19. This envelope is substantially tight and has only one lead-through opening, through which the cable 17 extends to the exterior.

The facing parts of the sheet 21 are connected to each other in a region between the two connections 19 by means of a further welding connection 25. The further welding connection 25 constitutes a separation wall between the two connections 19, as a result of which shortcircuit between these connections is avoided.

The connections 19 may be, for example, soldering or welding connections. For establishing a welding connection, use may be made, for example, of the part 27 shown in FIG. 4A, which consists of a metal plate which is bent into the shape of a U and is folded around the adjacent free ends 11 and 15 of the wire and the cable. The parts of the assembly thus formed are then welded to each other (the so-called "sandwich welding method"). Soldering and welding connections have the disadvantage that a supply of heat is necessary, which requires comparatively complicated operations and could lead to damage. Therefore, the connections 19 are preferably established in that, after the insulation has been removed, each free end 11 of the wire 5 and the associated free end of a core 15 of the cable 17 are secured with clamping fit in a deformable connection member. An example of such a connection member is shown in cross-section in FIG. 4B. The connection member 29 shown in FIG. 4B is a metal plate, whose edges are bent inwards so that two "crimp" connections are formed, which each hold one of the ends 11, 15 with clamping fit.

The second end (not shown) of the cable 17 may be provided, for example, with a connector for connecting the cable to a circuit for supplying the coil 1 with electric current. If desired, instead of the cable 17, also another connection member may be used, for example a known connector housing with fork springs, which is mounted in the sheet 21 of insulating foil in such a manner that a plug lead-in opening of the housing is accessible from the outside. The fork springs have connection parts which are connected to the free ends 11 of the wire 5. Due to the use of fork springs, the connector housing can have a very flat construction.

We claim:

1. A device for demagnetizing a picture tube of a television receiver comprising at least one demagnetization coil (1) wound from electrically conducting insulated wire (5) and surrounded by a sheath (7) formed from electrically insulating material, which coil is provided with a connection member (17) connected to the two ends (11) of the wire (5), the connections (19) of the connection member with the wire being surrounded by an electrically insulating envelope cooperating with the sheath (7), characterized in that the envelope is constituted by a sheet (21) of electrically insulating foil, which is folded so that the connections (19) of the connection member (17) with the wire (5) and the parts of the sheath (7) located near these connections are disposed between the facing parts of the sheet (21), the edges of the sheet contacting each other being connected to each other by means of a welding connection (23) and the sheet further being connected by means of a welding connection (23) to the sheath and to an envelope of the connection member (17), in a manner such that the sheet of foil (21) constitutes a substantially tight envelope for the connections (19).

2. A device as claimed in claim 1, characterized in that the connection member comprises a cable (17) having two electrically conducting insulated cores (15), the free ends of which are connected electrically and mechanically to corresponding ends (11) of the wire (5), which cable is directed near the connections (19) approximately transversely to the longitudinal direction of the wire (5).

3. A device as claimed in claim 2, characterized in that each connection (19) between the cable (17) and the wire (5) comprises a deformable metal connection member (27, 29), in which the end portions of the wire and of a core (15) of the cable are secured with clamping fit by deformation of said deformable metal connection member.

4. A device as claimed in claim 2 or 3, characterized in that the facing parts of the sheet (21) are connected in a region between the two connections (19) by means of a further welding connection (25) to each other for forming a separation wall between these connections.

5. A device as claimed in claim 1 or 2 or 3 characterized in that the sheet (21) of electrically insulating foil is made of the same material as the sheath (7) of the coil (1).

6. A device as claimed in claim 4, characterized in that the sheet (21) of electrically insulating foil is made of the same material as the sheath (7) of the coil (1).

* * * * *